US010514660B2

(12) United States Patent
Behra et al.

(10) Patent No.: US 10,514,660 B2
(45) Date of Patent: Dec. 24, 2019

(54) MECHANICAL WATCH WITH A CARILLON STRIKING MECHANISM

(71) Applicant: Blancpain SA, Le Brassus (CH)

(72) Inventors: Julien Behra, Les Rousses (FR); Mehdi Denden, Les Rousses (FR); Julien Peter, Gollion (CH)

(73) Assignee: Blancpain SA, Le Brassus (CH)

( * ) Notice: Subject to any disclaimer, the term of this patent is extended or adjusted under 35 U.S.C. 154(b) by 28 days.

(21) Appl. No.: 15/834,249

(22) Filed: Dec. 7, 2017

(65) Prior Publication Data

US 2018/0181070 A1 Jun. 28, 2018

(30) Foreign Application Priority Data

Dec. 23, 2016 (EP) ..... 16206572

(51) Int. Cl.
*G04B 21/06* (2006.01)
*G04B 21/04* (2006.01)
*G04B 21/10* (2006.01)

(52) U.S. Cl.
CPC ..... *G04B 21/06* (2013.01); *G04B 21/04* (2013.01); *G04B 21/10* (2013.01)

(58) Field of Classification Search
CPC ..... G04B 21/02; G04B 21/04; G04B 21/06; G04B 21/08; G04B 21/10; G04B 23/026; G10K 1/072; G10K 1/074; G10K 1/076; G10F 1/10
See application file for complete search history.

(56) References Cited

U.S. PATENT DOCUMENTS 8,374,057 B2 * 2/2013 Journe ..... G04B 21/12 368/72
8,599,651 B2 * 12/2013 Goeller ..... G04B 21/12 368/244
8,625,395 B2 * 1/2014 Goeller ..... G04B 19/23 368/267
8,873,347 B2 * 10/2014 Goeller ..... G04B 21/00 368/261
10,261,472 B2 * 4/2019 Bernard ..... G04B 21/04
(Continued)

FOREIGN PATENT DOCUMENTS

CH 704 590 A2 9/2012
EP 1 416 342 A1 5/2004

OTHER PUBLICATIONS

European Search Report dated Sep. 22, 2017 in European Application 16206572.6 filed on Dec. 23, 2016 (with English Translation of Categories of Cited Documents).

*Primary Examiner* — Sean P Kayes
*Assistant Examiner* — Jason M Collins
(74) *Attorney, Agent, or Firm* — Oblon, McClelland, Maier & Neustadt, L.L.P.

(57) ABSTRACT

Timepiece movement with a carillon striking mechanism, striking the hours and quarter-hours with different melodies, the striking mechanism including a quarter surprise-piece coaxial to and superposed on the quarter-snail, in a limited angular travel with respect to the quarter-snail, arranged to ensure the sequential playing of the melodies of the four quarter-hours on the full hour, in the first minute of the new hour, and further including, in the plane of the quarter surprise-piece, a quarter surprise-piece jumper, arranged to drive and/or to lock this quarter surprise-piece.

19 Claims, 10 Drawing Sheets

(56) References Cited

U.S. PATENT DOCUMENTS

| | | | | |
|---|---|---|---|---|
| 2010/0214884 | A1* | 8/2010 | Corthesy | G04B 23/12 368/266 |
| 2012/0230165 | A1* | 9/2012 | Goeller | G04B 23/12 368/267 |

* cited by examiner

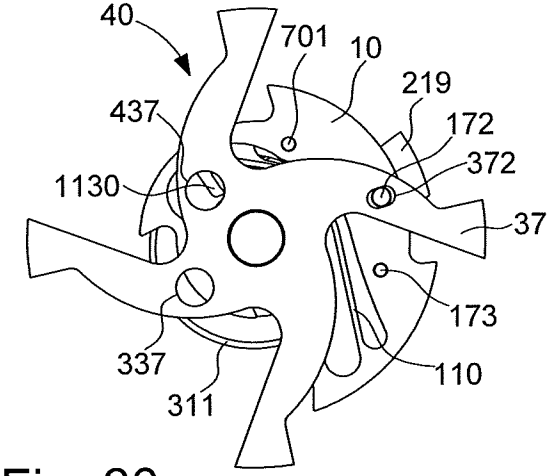
Fig. 25
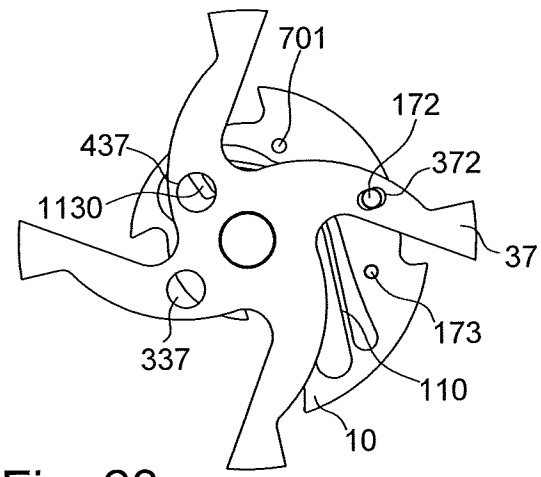
Fig. 27
Fig. 29
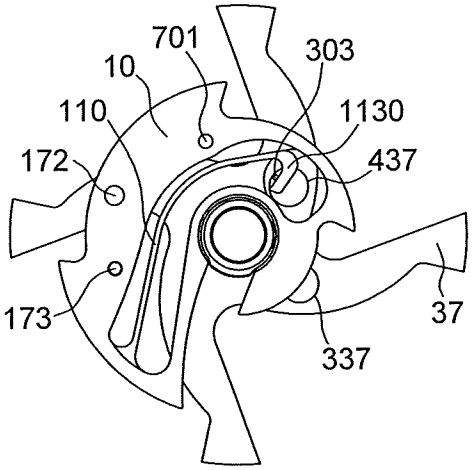
Fig. 26
Fig. 28
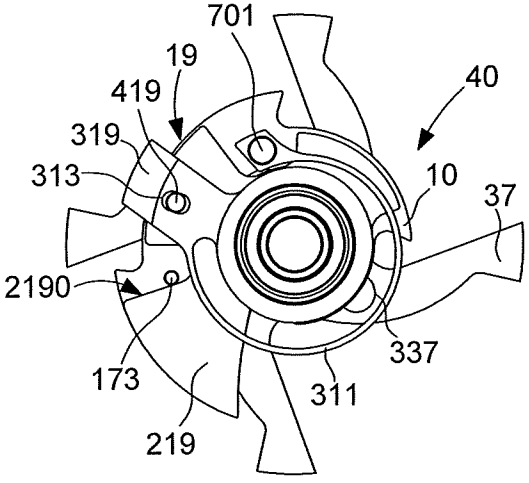
Fig. 30

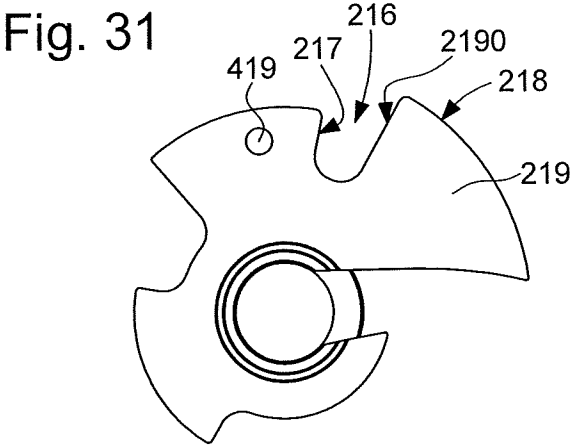
Fig. 31
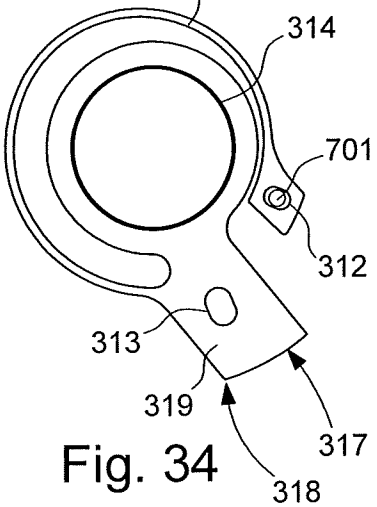
Fig. 33
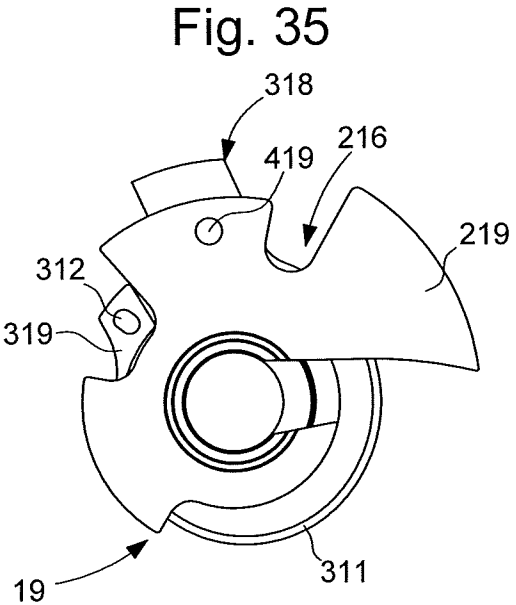
Fig. 35
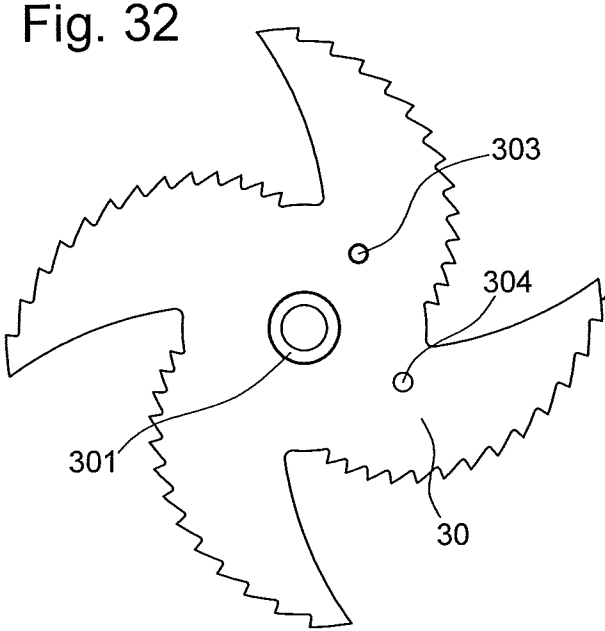
Fig. 34
Fig. 32

MECHANICAL WATCH WITH A CARILLON STRIKING MECHANISM

This application claims priority from European Patent Application No. 16206572.6 filed on Dec. 23, 2016, the entire disclosure of which is incorporated herein by reference.

FIELD OF THE INVENTION

The invention concerns a timepiece movement with a carillon striking mechanism, striking the hours and quarters with different melodies, said movement including drive means arranged to drive at least one quarter-snail, said striking mechanism comprising:

- an hour-snail, which is carried by an hour-star held by an hour-jumper and positioned at each hour by a quarter-pin integral with said quarter-snail,
- a quarter-rack drive pinion, driven by a strike train and arranged to drive a pivoting quarter-rack, whose pivoting travel is limited by a quarter-feeler, which is integral with said quarter-rack and arranged to come to rest on said quarter-snail,
- a pivoting minute-rack, whose pivoting travel is limited by a minute-feeler which is integral with said minute-rack and arranged to come to rest on a minute-snail driven by said drive means of said movement,
- said quarter-rack comprising a drive means arranged for driving the drive teeth of said minute-rack,
- a minute surprise-piece, which is coaxial to and superposed on said minute-snail, integral in rotation with said quarter-snail, and at least partially free to pivot with respect to said minute-snail, cooperating with a jumper spring of the minute surprise-piece and arranged to extend the zero minute step of said minute-snail, immediately after the change of quarter-hour and during the first minute.

The invention concerns the field of striking mechanisms, particularly with chimes or a carillon, for fine horology, especially for watches.

BACKGROUND OF THE INVENTION

Striking mechanisms are amongst the most prized complications in fine horology. Integrating such mechanisms in a watch is always complex.

Generally, conventional grande sonnerie mechanisms have two gongs, a lower pitched "dong" used for striking the hours, and combined with a higher pitched "ding" for striking each quarter "ding-dong", this higher pitched gong can also be used for striking the minutes if the watch is equipped to do so.

A grande sonnerie mechanism with a carillon or chimes is designed to play a short melody at every quarter-hour, and on the full hour. In the most elaborate carillons, a different melody is played for each quarter-hour. And the melody played on the hour is the sequence resulting from the individual quarter-hour melodies.

It is difficult to play a melody at a precise time. The surprise-piece provides better precision as regards the instant at which the strike function starts. In order to avoid any error during striking an extremely precise adjustment must be made of the components, for example to make a stylus cooperate with a notch: such a mechanism is very difficult to adjust, and any shock may impair this adjustment.

One alternative could consist in making the snails larger, with a modification of their time period. However, the space available, which depends on the other complications, does not always permit such an arrangement.

EP Patent Application No 1416342A1 in the name of NOUVELLE LEMANIA SA discloses a striking timepiece comprising a centre wheel set that makes one revolution per hour and is provided with a first snail and a surprise-piece associated with the latter, a second snail, a pivoting rack connected to a striking work control member and provided with a feeler arranged to abut against the second snail when the striking work control member is actuated, a surprise-piece jumper for pivoting the surprise-piece onto the first snail, and a surprise-piece isolator device that keeps the surprise-piece jumper away from the surprise-piece when the rack is in the rest position. This surprise-piece isolator device includes a projecting element fixed to the rack, and arranged to cooperate with the surprise-piece jumper to move the latter away from the surprise-piece.

CH Patent Application No 704590A2 in the name of MONTRES BREGUET SA discloses an isolating mechanism for a timepiece, including, on the one hand, a timepiece movement and, on the other hand, at least one striking mechanism including feeler arms for reading time information, on time references driven by said timepiece movement. This isolating mechanism includes at least a first isolator, arranged to cooperate with a control mechanism of the timepiece, in order, in a first armed position, to adopt a stop position that prevents the time information feelers from searching for information on the time references, and, in a second unarmed position, to allow the passage of the feelers to come into contact with the time references.

SUMMARY OF THE INVENTION

The invention proposes to create a compact alternative, which allows the carillon chimes to be released with great precision, and uses the fewest possible components of a conventional grande sonnerie mechanism.

To this end, the invention concerns a timepiece movement according to claim 1.

The invention also concerns a watch, which is a mechanical watch with a carillon striking mechanism, and includes such a movement.

The invention also concerns a clock, which is a mechanical clock with a carillon striking mechanism, and includes such a movement.

BRIEF DESCRIPTION OF THE DRAWINGS

Other features and advantages of the invention will appear upon reading the following detailed description, with reference to the annexed drawings, in which:

FIG. 1 represents a schematic, plan view of one part of a striking mechanism comprised in the movement according to the invention, with a quarter-rack in superposition on a minute-rack. In a known manner, the minute-rack is coplanar with a minute-snail, which can be extended, during the first minute after the release of a quarter chime, to be sensed by the feeler of the minute-rack, by a minute surprise-piece in a nearby plane, where this minute surprise-piece cooperates with a minute surprise-piece jumper. In a manner peculiar to the invention, the quarter-rack is coplanar with a quarter-snail, which can be extended, during the first minute after the release of a quarter chime, to be sensed by a feeler of the quarter-rack, by a quarter surprise-piece arranged in a nearby plane, where the quarter surprise-piece cooperates with a quarter surprise-piece jumper. FIG. 1 shows the position of the assembly at the 59th minute, just prior to the release of the chimes to strike the hour, and the quarter surprise-piece jumper is retaining the quarter surprise-piece.

FIG. 2 represents, in a similar manner to FIG. 1, the same mechanism at zero minutes, in a position where the quarter surprise-piece jumper is in tip-to-tip contact with the quarter surprise-piece.

FIG. 3 represents, in a similar manner to FIGS. 1 and 2, the same mechanism at the 1st minute, where the minute-rack is resting on the minute-snail, the mechanism is then in a position in which the quarter surprise-piece jumper pushes the quarter surprise-piece.

FIG. 4 represents a schematic, cross-sectional view of a snail assembly which, in a first variant of the invention, is a coaxial assembly that carries, assembled around the minute-snail, which is provided here with an arbor portion, the components of the invention which cooperate with the quarter and minute racks, and the quarter and minute surprise-piece jumpers. This particular and non-limiting snail assembly carries here, from its upper end towards its lower end: a cannon-pinion wheel cooperating with the timepiece movement, the minute-snail collar, the minute surprise-piece secured to the quarter-snail, which follows and on which the quarter surprise-piece pivots, axially stopped by an hour driver pressed onto the quarter-snail, then a finger pressed onto the tubular portion of the minute-snail forming the axial stop for the quarter-snail, this finger serving to lock or unlock the striking mechanism, and finally a four-toothed star, which is pressed onto the tubular portion and arranged to release the grande sonnerie mechanism at each quarter-hour.

FIG. 5 shows a schematic top view of the snail assembly of FIG. 4.

FIG. 6 represents a schematic top view of one part of the snail assembly of FIG. 4, showing only the minute-snail, the minute surprise-piece, and the quarter-snail provided with a strip spring inside a housing.

FIG. 7 represents a schematic, plan view of the minute-snail.

FIG. 8 represents a schematic, plan view of the minute surprise-piece.

FIG. 9 shows a schematic, plan view of the quarter-snail.

FIG. 10 represents a schematic, plan view of the quarter surprise-piece.

FIG. 11 represents a schematic, plan view of the hour driver.

FIGS. 12 to 20 illustrate, in a similar manner to FIGS. 1 to 3, the position of the different components, at the 59th minute in FIGS. 12 to 14, at zero minutes in FIGS. 15 to 17, and at the 1st minute in FIGS. 18 to 20, where FIGS. 12, 15 and 18 show, at these three instants, the cooperation between the minute-rack, the minute-snail and the minute surprise-piece;

where FIGS. 13, 16 and 19 show, at these three instants, the cooperation between the quarter-rack, the quarter-snail, the minute surprise-piece jumper and the minute surprise-piece. FIG. 16 further shows the quarter surprise-piece and the quarter surprise-piece jumper according to the invention;

where FIGS. 14, 17 and 20 show, at these three instants, in a similar manner to FIG. 16, the cooperation between the quarter-rack, the quarter-snail, the minute surprise-piece jumper and the minute surprise-piece, the quarter surprise-piece and the quarter surprise-piece jumper. These Figures also show the hour driver, arranged to drive, by a pin comprised therein, a twelve-toothed hour star wheel.

FIGS. 23 to 47 illustrate a second variant of the invention, wherein the quarter surprise-piece includes an upper portion and a lower portion which are made integral in rotation by a pin.

FIG. 23 shows a schematic top view of the snail assembly of the second variant.

FIG. 24 represents a schematic, cross-sectional view, similar to FIG. 4 of the first variant, of the snail assembly of the second particular variant of the invention, which is a coaxial assembly that carries, assembled around the minute-snail, which is provided here with an arbor portion, the components of the invention which cooperate with the quarter and minute racks, and the quarter and minute surprise-piece jumpers. This snail assembly carries, from its upper end towards its lower end: a cannon-pinion wheel cooperating with the timepiece movement, the minute-snail collar, the minute surprise-piece, integral in rotation with the quarter-snail, which follows and on which pivots the quarter surprise-piece, which comprises two superposed portions; the hour driver is pressed onto the minute surprise-piece, and the four-toothed star is pressed onto the tubular portion of the minute-snail, and is arranged to release the grande sonnerie mechanism at each quarter-hour. The views that follow, from the upper side (arrow A) will be referred to as "top" views, and those from the lower side (arrow B) will be referred to as "bottom" views and, up to FIG. 35, the odd numbered Figures are top views and the even numbered Figures are bottom views.

FIG. 25 represents a schematic, plan, top view of the quarter-snail, which carries a first snail pin, a second snail pin, and a third snail pin; the strip spring of the quarter-snail includes a hook which is arranged to cooperate with the first bearing pin comprised in the minute-snail.

FIG. 26 represents a schematic, plan, bottom view of the minute surprise-piece, which includes a lug arranged to cooperate in a complementary manner with a radial notch in the quarter-snail, in addition to a radial oblong aperture or positioning eye, a first aperture arranged to confine the same first bearing pin comprised in the minute-snail, and a second aperture arranged to confine a second banking pin carried by the minute-snail.

FIG. 27 represents a schematic, plan, top view of the superposed arrangement of the quarter-snail and the minute surprise-piece, and FIG. 28 represents a bottom view of the same assembly.

FIG. 29 represents a schematic, plan, top view of the superposed arrangement of the quarter-snail, the minute surprise-piece and the quarter surprise-piece detailed below, and FIG. 30 represents a bottom view of the same assembly.

FIG. 32 represents a schematic, plan, bottom view of the minute-snail, which carries a first bearing pin arranged to cooperate with the strip spring of the quarter-snail, and a second banking pin arranged to cooperate with the second aperture of the minute surprise-piece.

FIG. 31 represents a schematic, plan, top view of an upper portion of the quarter surprise-piece, which carries a pin for integral rotation with a lower portion of the quarter surprise-piece, represented in FIG. 33, which includes a first radial eye cooperating with this pin of the upper portion, and, at the end of a substantially circular spring arm, a second eye, which is arranged to cooperate with the third pin of the quarter-snail.

FIGS. 34 and 35 represent a schematic, plan, top and bottom view of the superposed arrangement of the upper portion and the lower portion of the quarter surprise-piece.

FIGS. 36 and 37 represent a schematic, plan view, similar to FIGS. 1 to 3, of a part of the striking mechanism with this second variant comprised in the movement according to the invention, in the rest position, and in a top and bottom view; the bottom view in FIG. 38 includes the four-toothed star wheel which is not represented in FIG. 37.

FIGS. 39 to 47 illustrate, in a similar manner to FIGS. 12 to 20, the position of the different components, at the 59th minute in FIGS. 39 to 41, at zero minutes in FIGS. 42 to 44, and at the 1st minute in FIGS. 45 to 47:

Figure 41:
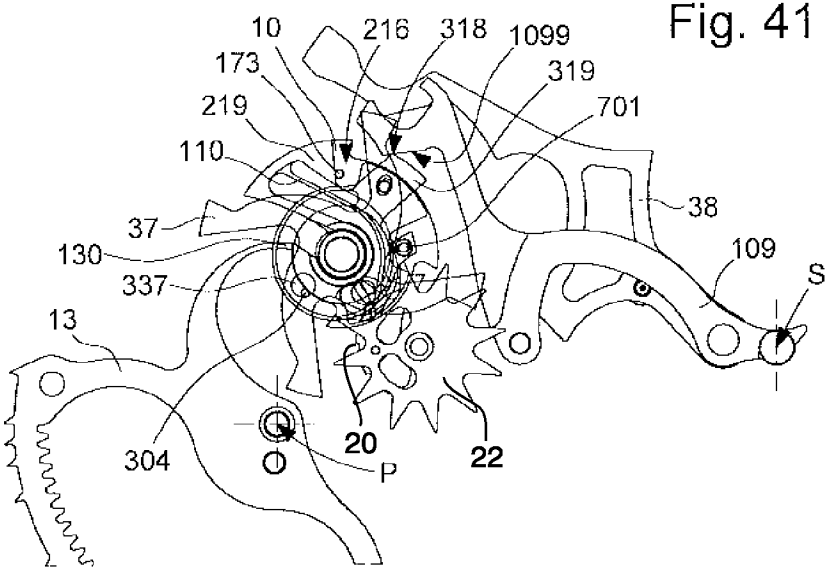
Figure 39:
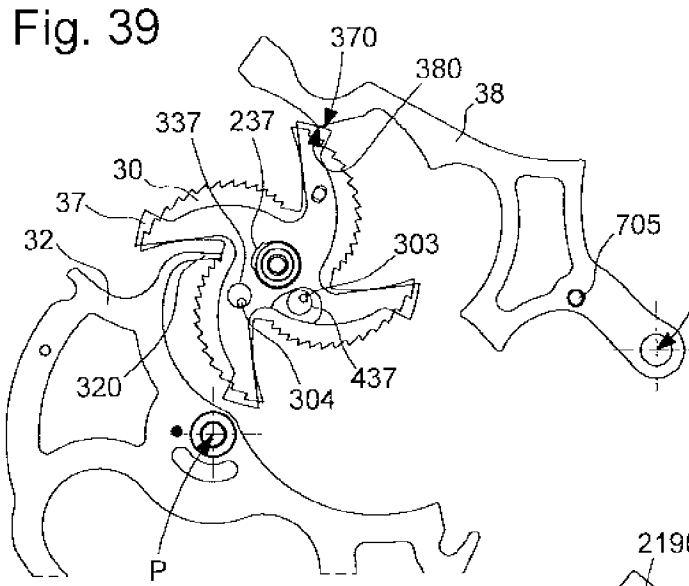
Figure 40:
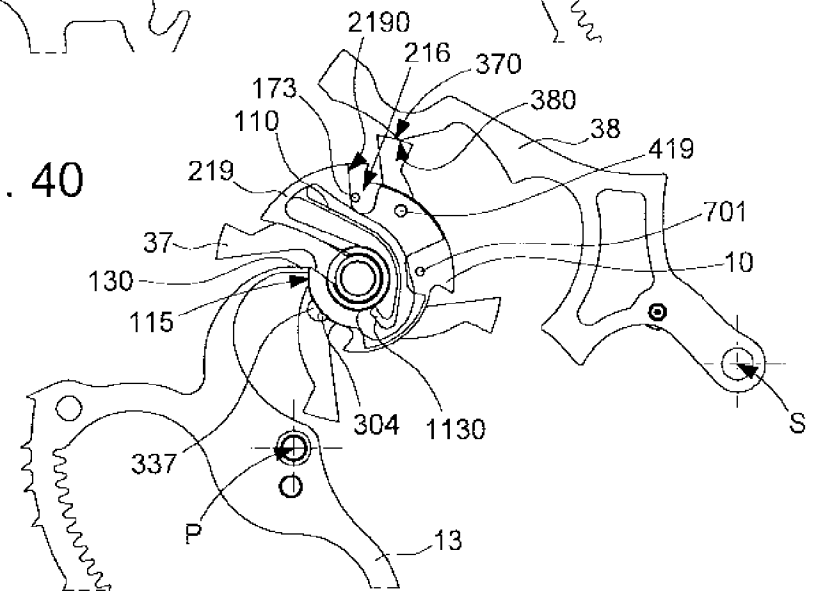
Figure 44:
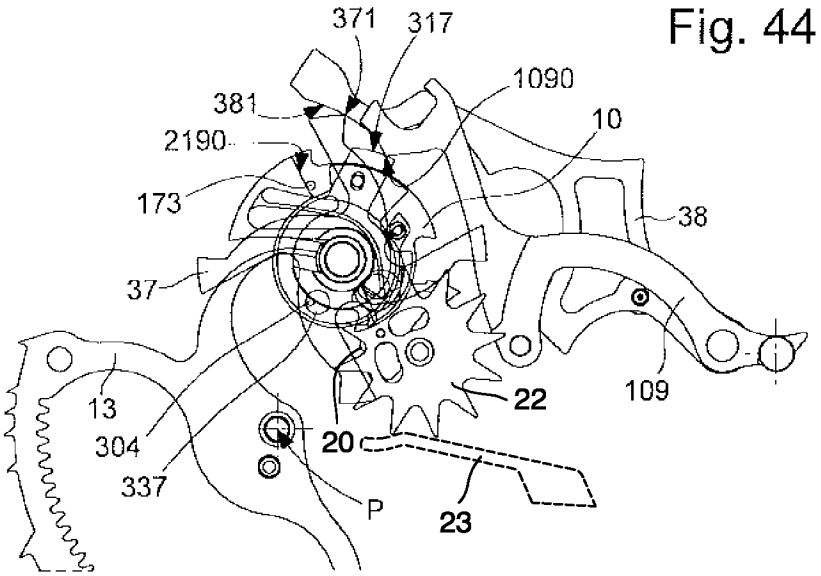
Figure 42:
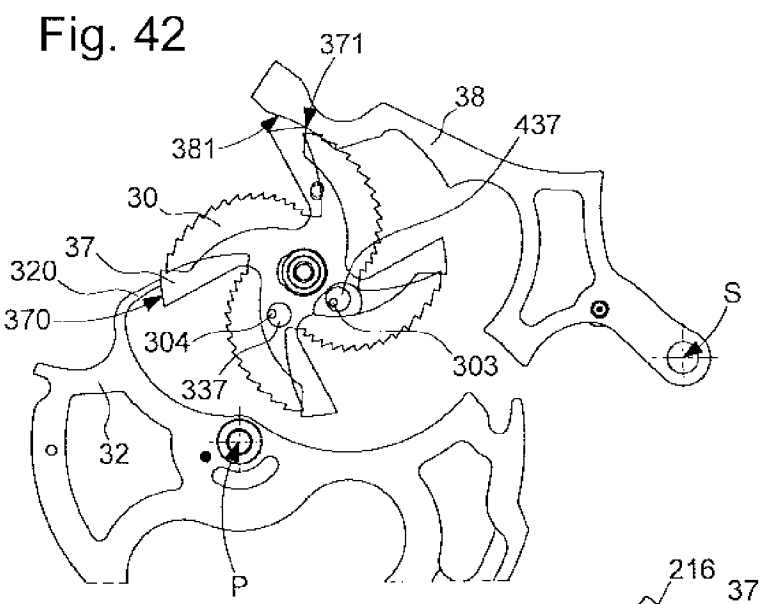
Figure 43:
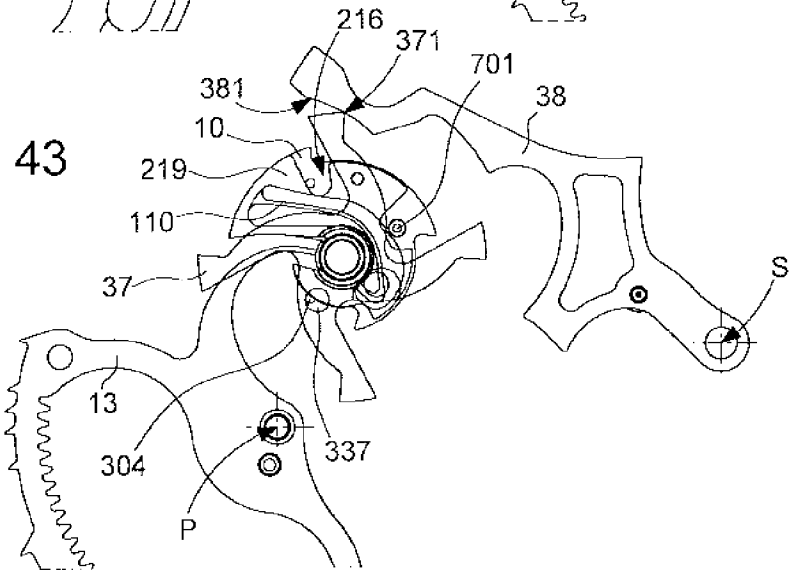
Figure 47:
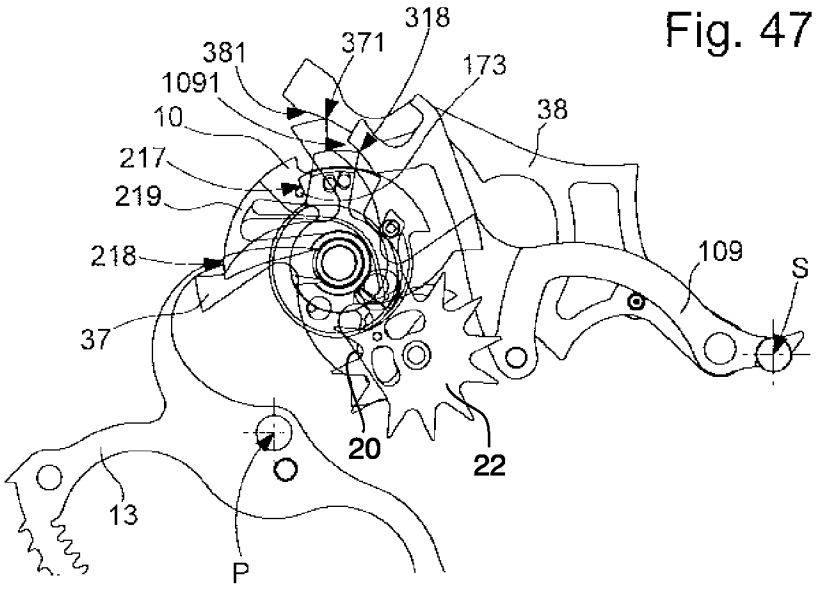
Figure 45:
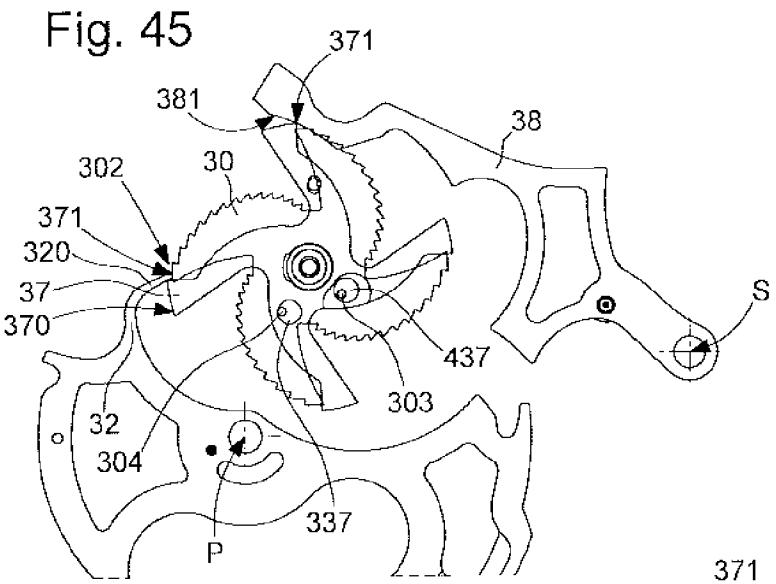
Figure 46:
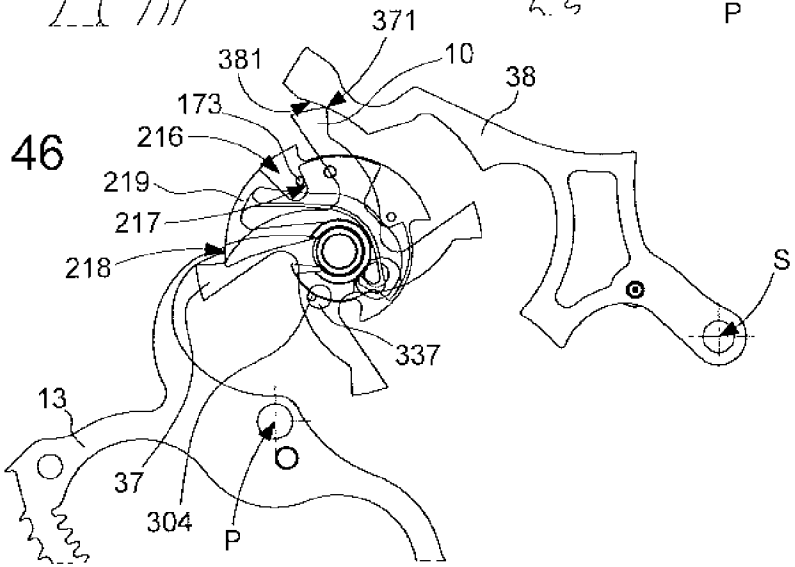

where FIGS. 39, 42 and 45 more precisely show the minute surprise-piece and, at these three instants, the cooperation between the minute-rack, the minute-snail and the minute surprise-piece;

where FIGS. 40, 43 and 46 more precisely show the quarter-snail and, at these three instants, the cooperation between the quarter-rack, the quarter-snail, the minute surprise-piece jumper and the minute surprise-piece;

where FIGS. 41, 44 and 47 more precisely show the quarter surprise-piece and, at these three instants, the cooperation between the quarter-rack, the quarter-snail, the minute surprise-piece jumper and the minute surprise-piece, the quarter surprise-piece and the quarter surprise-piece jumper. These Figures also show the hour driver arranged to drive, via a pin comprised therein, a twelve-toothed hour star wheel.

DETAILED DESCRIPTION OF PREFERRED EMBODIMENTS

The invention concerns a timepiece movement 200 including a carillon striking mechanism 100, arranged to strike at least the hours and the quarter-hours, with, for each one-hour period, a different melody for each quarter-hour and for the full hour. More particularly, this striking mechanism 100 is arranged to play, on the full hour, and in sequence, the four different melodies played at the quarter-hours. More particularly, this striking mechanism 100 is arranged first to strike the number of hours, then play the melodies.

This movement 200 includes, in a conventional manner, drive means, which are arranged to drive, amongst other things, at least one quarter-snail 10.

The present description does not describe in detail the entire composition of the striking mechanism, the manufacturing details of which are known to those skilled in the art, specialised in striking complications in horology, in particular from the work entitled A Guide to Complicated Watches (Les montres compliquées) by François Lecoultre, Editions horlogères, Bienne (Switzerland), ISBN 2-88175-000-1 for the French edition, or ISBN 2-88175-002-8 for the German edition, or ISBN 2-88175-001-X for the English edition, and more particularly but not limited to the chapters entitled "Repeating watches", "Old repeating watches", Modern quarter repeaters", "Simplified repeater, Half-quarter repeaters", Breguet half-quarter repeater", "Five-minute repeater", Minute-repeaters", and "Clock watches".

This latter chapter entitled "Clock watches" more particularly concerns the context of the invention; the clock watch or grande sonnerie mechanism strikes the hours and the quarters at least in passing, with no intervention by the user.

Only the noteworthy components, required for implementation of the invention, are referred to below.

In the present case, striking mechanism 100 includes:

- an hour-snail 20, which is carried by an hour-star wheel 22 held by an hour-jumper 23 and which is positioned at each hour by a quarter-pin 29 integral with quarter-snail 10,
- a quarter-rack drive pinion 12 driven by a strike train, and arranged to drive a pivoting quarter-rack 13, whose pivoting travel is limited by a quarter-feeler 14 integral with quarter-rack 13 and which is arranged to come to rest on quarter-snail 10,
- a pivoting minute-rack 32 whose pivoting travel is limited by a minute-feeler 31 integral with minute-rack 32 and which is arranged to come to rest on a minute-snail 30 driven by the drive means of movement 200, quarter-rack 13 including a drive means arranged for driving drive teeth 39 comprised in minute-rack 32,
- a minute surprise-piece 37 coaxial to and superposed on minute-snail 30, integral in rotation with quarter-snail 10, and at least partially free to pivot with respect to minute-snail 30, cooperating with a minute surprise-piece jumper 38 and arranged to extend a zero minute step of minute-snail 30, immediately after the change of quarter-hour and during the first minute after a quarter.

According to the invention, striking mechanism 100 includes a quarter surprise-piece 19, coaxial to and superposed on quarter-snail 10, and at least partially free to pivot in a limited angular travel with respect to quarter-snail 10, which is arranged to ensure the sequential playing of the four quarter melodies on the full hour, in the first minute of the new hour. Striking mechanism 100 also includes, in the plane of quarter surprise-piece 19, a quarter surprise-piece jumper 109, which is arranged to drive and/or to lock quarter surprise-piece 19.

Depending on the embodiment, quarter surprise-piece 19 may be a one-piece element, as in the first variant, illustrated by FIGS. 1 to 19, or a sub-assembly incorporating several elements, as in the second variant, illustrated by FIGS. 23 to 47, where quarter surprise-piece 19 includes at least an upper portion 219 and a lower portion 319, which are coaxial and pivot integrally, made integral in rotation by a surprise-piece pin 419.

This quarter surprise-piece jumper 109 may, depending on the variant embodiment, be pushed by an elastic return means, particularly a spring, or be formed of such an elastic return means.

In a particular variant, quarter surprise-piece jumper 109 is articulated with minute surprise-piece jumper 38.

In another particular variant (not illustrated), quarter surprise-piece jumper 109 forms a one-piece assembly with minute surprise-piece jumper 38.

In yet another particular variant (not illustrated), quarter surprise-piece jumper 109 is articulated with minute surprise-piece jumper 38. It is noted that quarter-snail 109 and minute surprise-piece jumper 38 are in different planes, this difference in level must therefore be rectified, for such an articulated connection, for example by a control pin, and, more particularly, this articulated connection includes an elastic connection by means of a spring or suchlike.

More particularly, quarter-rack 13 includes first quarter teeth 15 arranged to cooperate with a first quarter hammer trip for actuating a first quarter hammer arranged to strike a first quarter gong, and including second quarter teeth 105, arranged to cooperate with a second quarter hammer trip for actuating a second quarter hammer arranged to strike a second quarter gong, the first quarter teeth 15 and second quarter teeth 105 being spaced out to obtain a series of first sounds and second sounds, to strike the quarters.

More particularly, striking mechanism 100 is arranged to strike the minutes, minute-rack 32 includes minute teeth 33 which are arranged to cooperate with a minute hammer trip for actuating a minute hammer arranged to strike a minute gong.

More particularly, in the case of a grande sonnerie mechanism, striking mechanism 100 includes a strike barrel, which is wound by the winding stem of movement 200. The striking mechanism is released by means of a release lever which gears with a detent ratchet causing the release of minute-rack 32, quarter-rack 13, and an hour-rack; each of these three components has its own return spring. Since the detent ratchet releases these components, the springs can then press them onto their respective snails.

Figure 3:
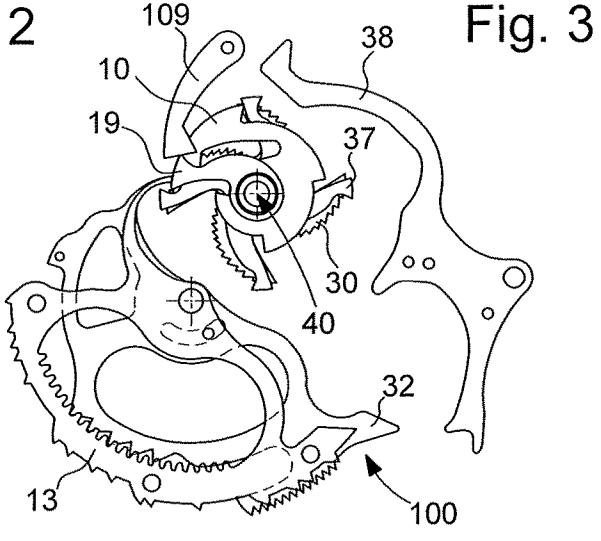
FIGS. 1 to 19 illustrate a first variant of the invention.
Figure 2:
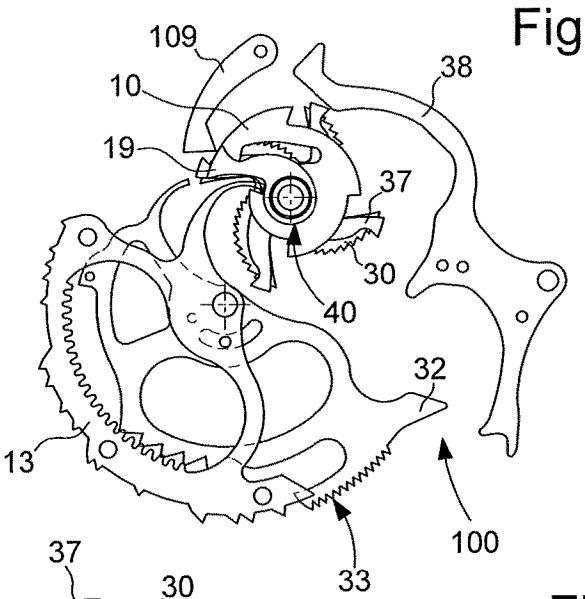
Figure 1:
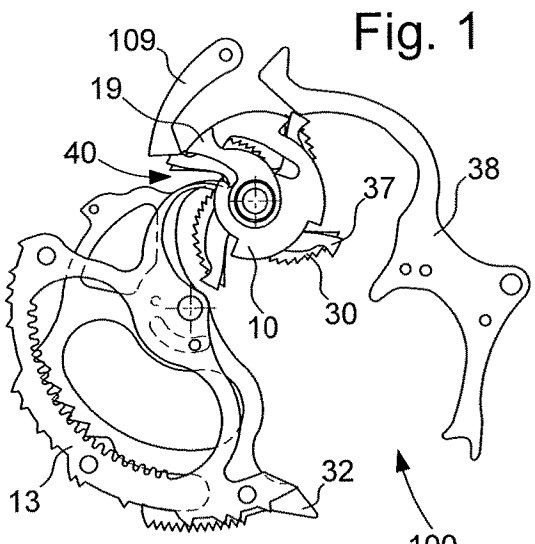
Figure 4:
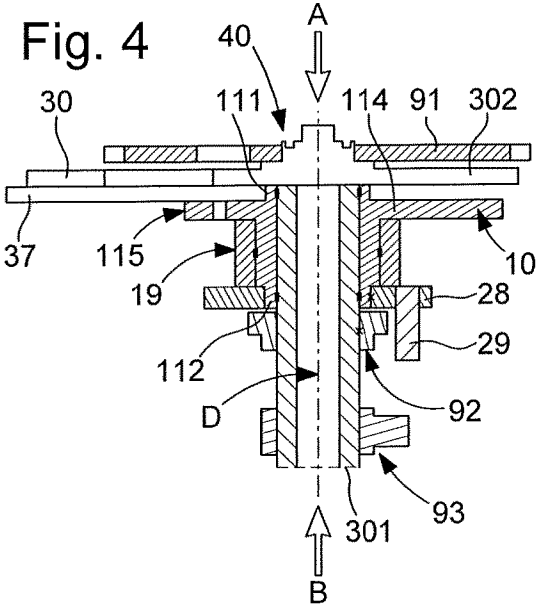
Figure 5:
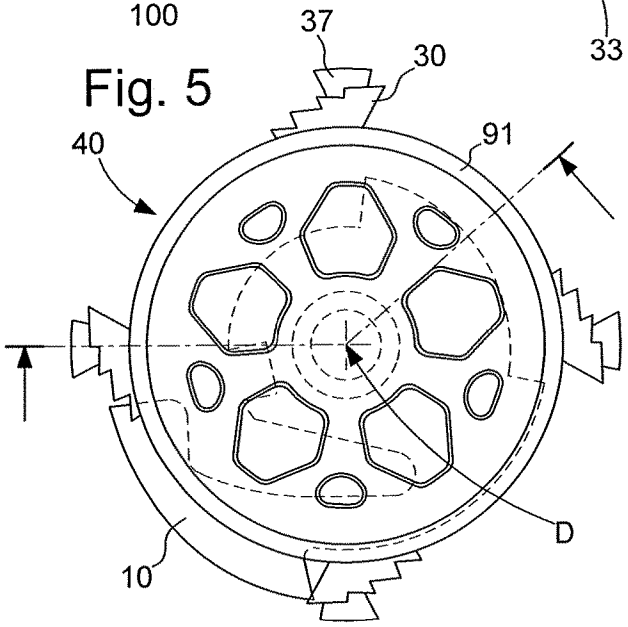
Figure 7:
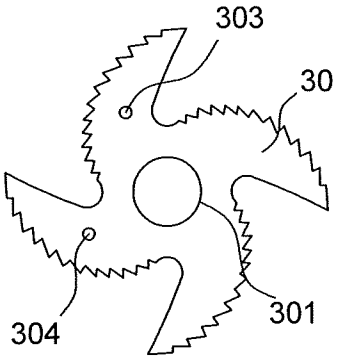
Figure 8:
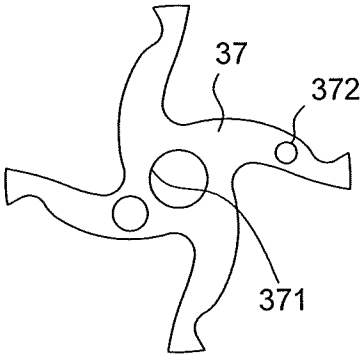
Figure 9:
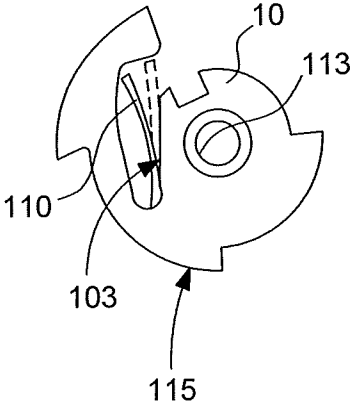
Figure 10:
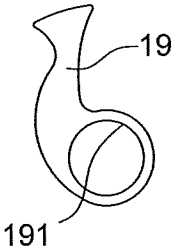
Figure 11:
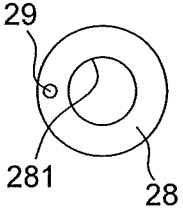
Figure 6:
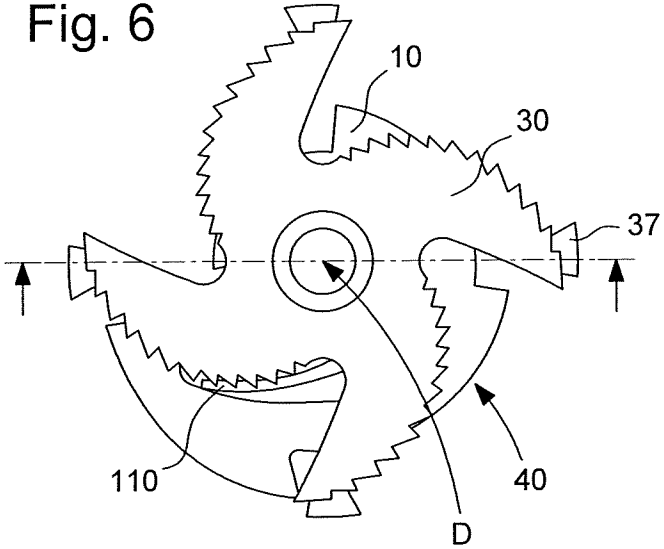
Figure 21:
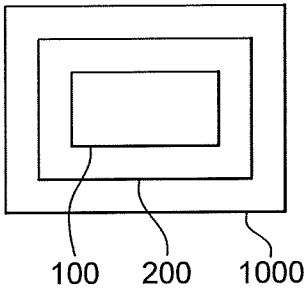
FIG. 21 is a block diagram which represents a watch comprising a movement according to the invention, with a striking mechanism as illustrated.
Figure 22:
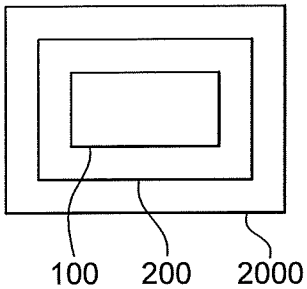
FIG. 22 is a block diagram which represents a clock comprising a movement according to the invention, with a striking mechanism as illustrated.
Figure 14:
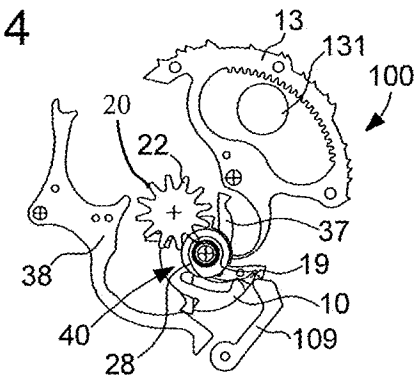
Figure 13:
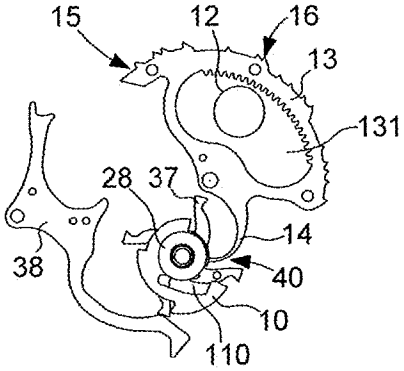
Figure 12:
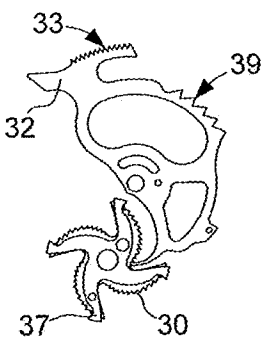
Figure 17:
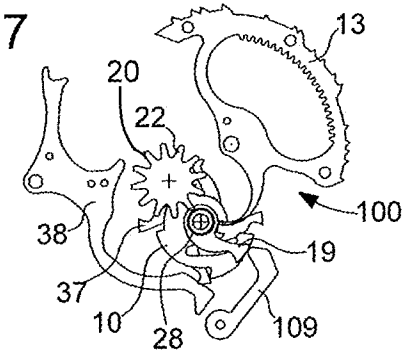
Figure 16:
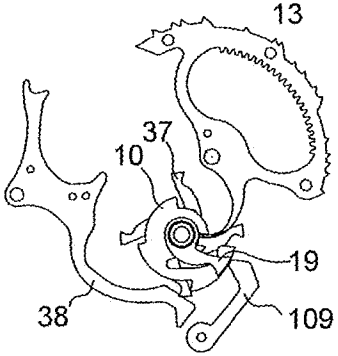
Figure 15:
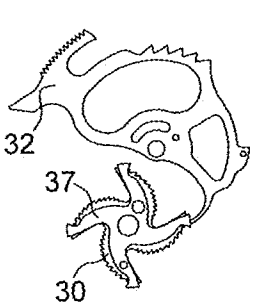
Figure 20:
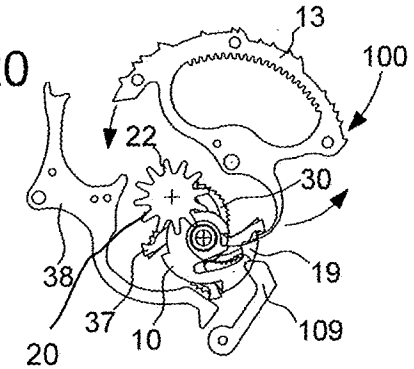
Figure 19:
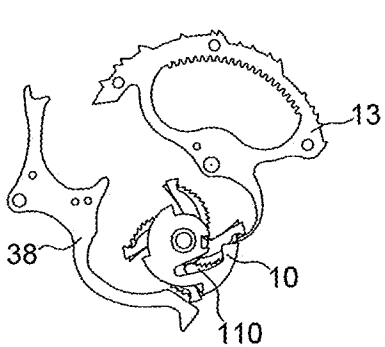
Figure 18:
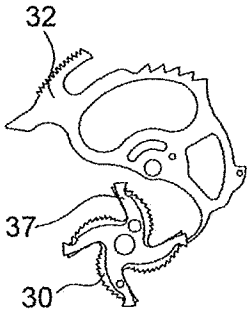

More particularly, as seen in FIGS. 4 and 5, striking mechanism 100 includes a snail assembly 40 which includes, mounted coaxially about the same axis D:

- minute-snail 30 which includes a tubular portion 301 on which pivots a first bore 113 of quarter-snail 10. This quarter-snail 10 includes, on either side of a quarter-collar 114 that carries on the rim thereof a quarter cam 115:
- on the one hand, a first shoulder 111 for centering a bore 371 of minute surprise-piece 37. This minute surprise-piece 37 is inserted between quarter-collar 114 and a minute-collar 302 comprised in minute-snail 30,
- and on the other hand, an arbor portion 112, on which pivots a bore 191 of quarter surprise-piece 19, which is confined between quarter-collar 114 and an hour driver 28. This hour driver 28 is pressed onto arbor portion 112, and integral with quarter-snail 10, and is arranged to limit the axial play of quarter surprise-piece 19. This hour driver 28 carries quarter pin 29, parallel to axis D, for driving hour star wheel 22.

More particularly, snail assembly 40 also includes a cannon-pinion wheel 91, which is integral in rotation with minute-snail 30, driven by the drive means of movement 200, and making one revolution per hour.

More particularly, snail assembly 40 also includes a finger 92 which is pressed onto tubular portion 301, and which is arranged to limit the axial play of quarter-snail 10, and to lock or unlock the striking mechanism, by cooperating with a lever comprised in striking mechanism 100, to release the hour drive means on the full hour.

More particularly, snail assembly 40 also includes a four-toothed star wheel 93, pressed onto tubular portion 301, and which is arranged to release the grande sonnerie mechanism at each quarter-hour.

Preferably, quarter surprise-piece 19 includes a banking pin, which is arranged to cooperate with a first circular or oblong housing, comprised in quarter-snail 10.

Preferably, minute-snail 30 includes a first bearing pin 303, which is arranged to cooperate in abutment with a strip spring 110 cantilevered on a point of attachment 103 of quarter-snail 10. This point of attachment 103 may be a braze, a laser solder or weld or other type. In a variant, for example made of micromachinable material, shaped by a LIGA or similar process, quarter-snail 10 may be in one-piece with strip spring 110 attached at 103.

Preferably, minute-snail 30 includes a second banking pin 304, which is arranged to cooperate with a second circular or oblong housing 372, comprised in minute surprise-piece 37.

FIGS. 23 to 47 illustrate a second variant of the invention, wherein quarter surprise-piece 19 includes an upper portion 219 and a lower portion 319 made integral in rotation by a pin 419.

Figure 24:
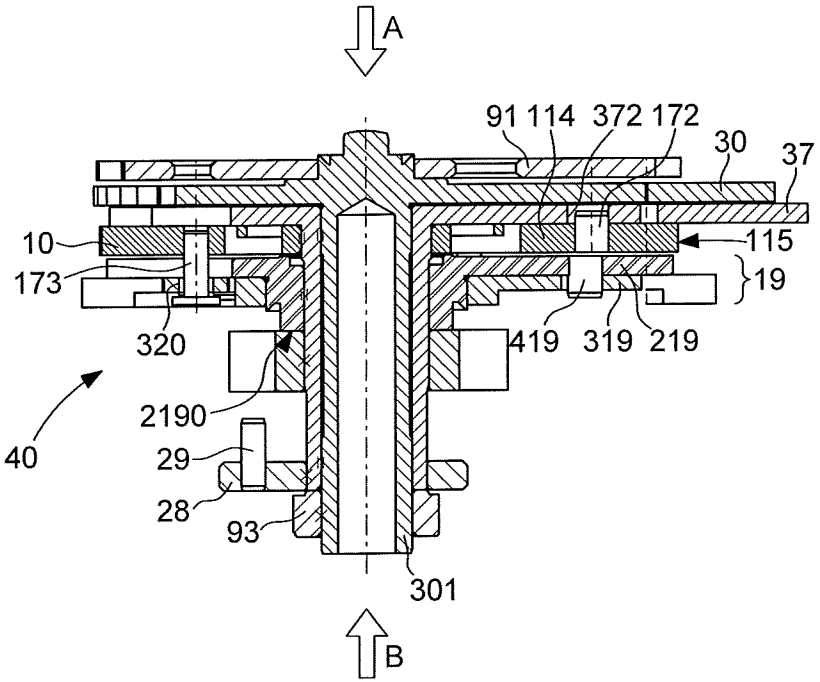

FIG. 24 represents the snail assembly of the second variant, which is a coaxial assembly that carries, assembled around minute-snail 30, which is provided here with an arbor portion, the components which cooperate with the quarter and minute-racks, and the quarter and minute surprise-piece jumpers. This snail assembly carries, in the direction of arrow A, from its upper end towards its lower end:

- a cannon-pinion wheel 91 cooperating with the timepiece movement,
- the collar of minute-snail 30,
- minute surprise-piece 37, which include an oblong hole 372 for driving integrally in rotation a second snail pin 172 carried by quarter-snail 10 which follows,
- on which pivots quarter surprise-piece 19, which is composed of two superposed portions: upper portion 219 and lower portion 319;
- an hour driver 28, carrying a pin 29 for driving the hour-star 22 with twelve teeth, is pressed onto a tubular portion comprised in minute surprise-piece 37;
- a four-toothed star wheel 93 is pressed onto the tubular portion of minute-snail 30, and is arranged to release the grande sonnerie mechanism at each quarter-hour.

Figure 23:
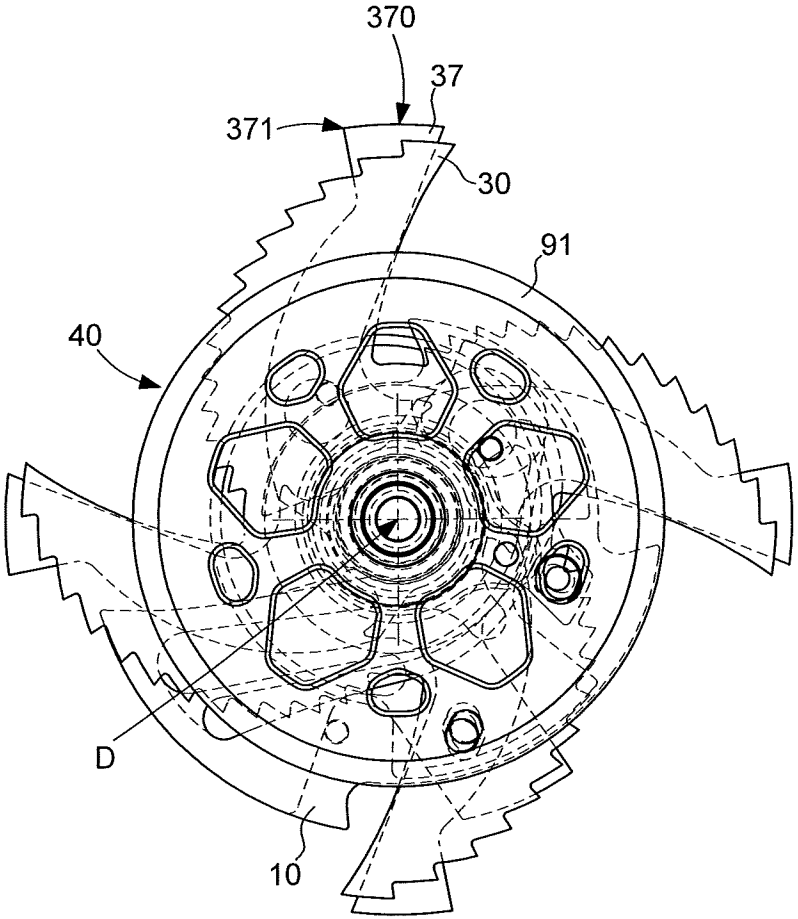
Figure 38:
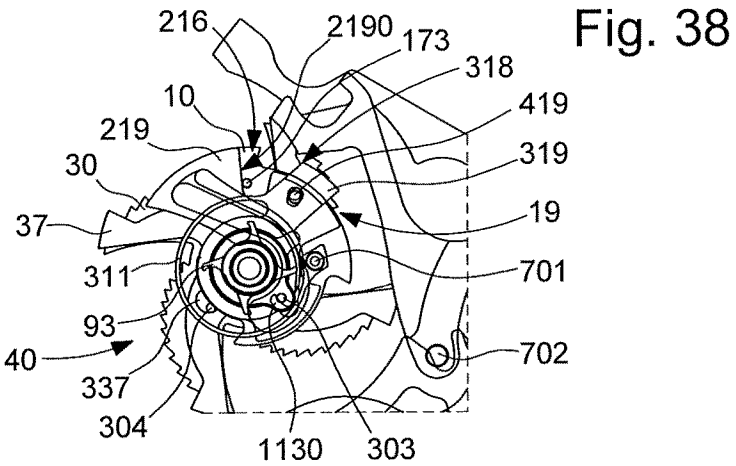

FIGS. 23 and 24 illustrate the rest position of the striking mechanism, where everything is wound, the striking mechanism regulator is stopped, and the striking mechanism is able to be released again.

Quarter surprise-piece 19 is superposed on minute surprise-piece 37, with respect to which it can pivot in a limited manner.

Minute snail 30 carries a first bearing pin 303 arranged to cooperate with strip spring 110 of quarter-snail 10, and a second banking pin 304, arranged to cooperate with minute surprise-piece 37.

FIGS. 25 to 28 show the juxtaposition of quarter-snail 10 and minute surprise-piece 37, which are integral in rotation, and, for example, but not exclusively, riveted onto each other or suchlike. The tubular assembly is then housed on a tubular portion comprised in minute-snail 30, as seen in FIG. 24. Minute-snail 30 is driven by the movement and is still biased owing to the gear train. Minute surprise-piece 37 can pivot with respect to minute-snail 30. Quarter surprise-piece 19 is mounted for free rotation with respect to minute surprise-piece 37.

Quarter snail 10 carries a first snail pin 173, a second snail pin 172, and a third snail pin 701; its strip spring 110 includes a hook 1130, which is arranged to cooperate with first bearing pin 303 comprised in minute-snail 30. This quarter-snail 10 may, in this variant, be economically made in a flat, stamped form, or made of micromachinable material, silicon or suchlike, by a LIGA or MEMS or similar process; it includes here a radial notch 116 that opens to cooperate with a lug 237 of minute surprise-piece 37, which has a tubular portion here.

The cooperation between hook 1130 of strip spring 110 and first bearing pin 303 of minute-snail 30 ensures that the striking unit is automatically returned to its original position, particularly if minute surprise-piece 37 is shifted by a deliberate or unintentional action on its jumper 38, the mechanism ensures the return to the initial position.

To this end, minute surprise-piece 37 also includes an oblong radial aperture or positioning eye 372 for cooperating with second snail pin 172, a first aperture 437, which is arranged to confine first bearing pin 303 comprised in minute-snail 30, and a second aperture 337, which is arranged to confine a second banking pin 304 carried by minute-snail 30, in order to return the striking unit to its initial position.

Quarter surprise-piece 19 includes two superposed portions here: upper portion 219 and lower portion 319, which pivot integrally. Upper portion 219 of quarter surprise-piece 19 carries a pin 419 for integral rotation with a first radial eye 313 of lower portion 319 of the quarter surprise-piece. This lower portion 319 includes, at the end of a substantially circular spring arm 311, a second eye 312, which is arranged to cooperate with third pin 701 of quarter-snail 10, which is mobile inside a radial notch 216 comprised in upper portion 219, to limit the travel of upper portion 219 with respect to quarter-snail 10. Spring arm 311 tends to return upper portion 219 to its rest position with respect to the quarter-snail, in particular in the event of a jump caused by the surprise-piece: when the quarter surprise-piece jumps, the spring tends to return the pin back into its initial stop position.

More particularly, and as seen in the variant illustrated by the FIGS. 31 to 35, upper portion 219 has, on its periphery, four circular sectors of different radii, corresponding to the four quarters, and corresponding to the respective sectors of quarter-snail 10. Some of these sectors are separated by notches, the peripheral portion of largest radius 218, corresponding to the corresponding sector of the quarter-snail 10, is thus separated from the sector of immediately smaller radius by a notch 216 having two sides 217 and 2190.

Lower portion 319 includes a lug comprising a circular sector 317 of the same larger radius value, and which ends in an edge 318. FIGS. 34 and 35 illustrate the superposed arrangement of this upper portion 219 and lower portion 319.

FIGS. 27 and 28 illustrate the superposed arrangement of quarter-snail 10 and minute surprise-piece 37, and the cooperation between positioning eye 372 and second snail pin 172.

FIGS. 29 and 30 illustrate the superposed arrangement of quarter-snail 10, minute surprise-piece 37 and quarter surprise-piece 19. These Figures show the cooperation in abutment between first snail pin 173 and side 2190 of notch 216 of upper portion 219, and the cooperation between third snail pin 701 and second eye 312 of lower portion 319. Spring 311 of this lower portion 319 makes it taut, and always tends to bring upper portion 219 back against pin 312.

Figure 37:
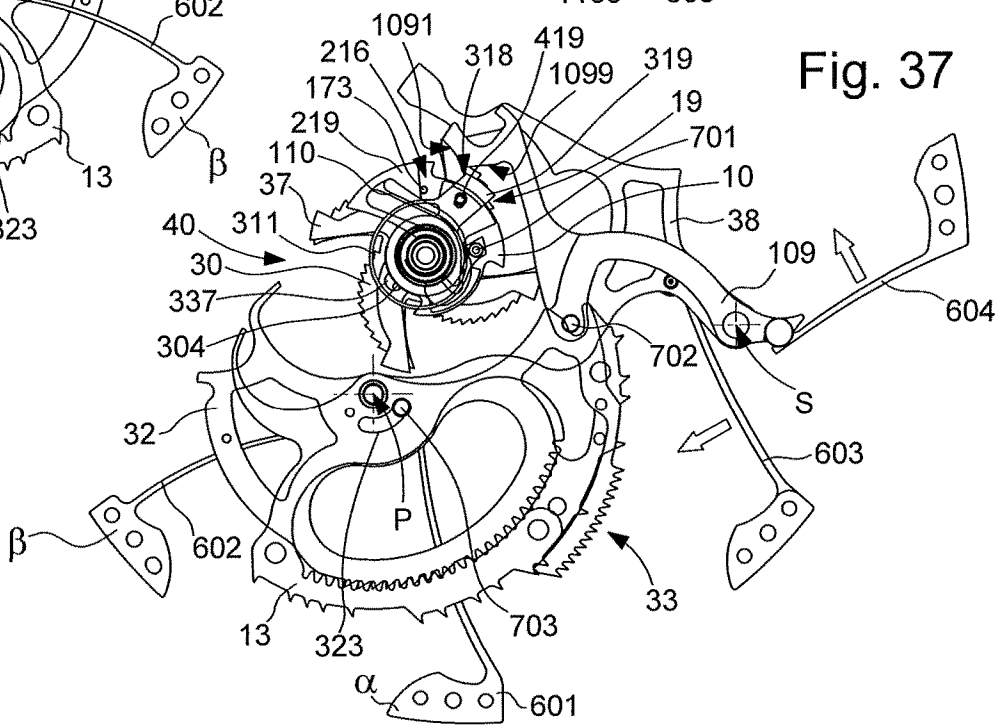
Figure 36:
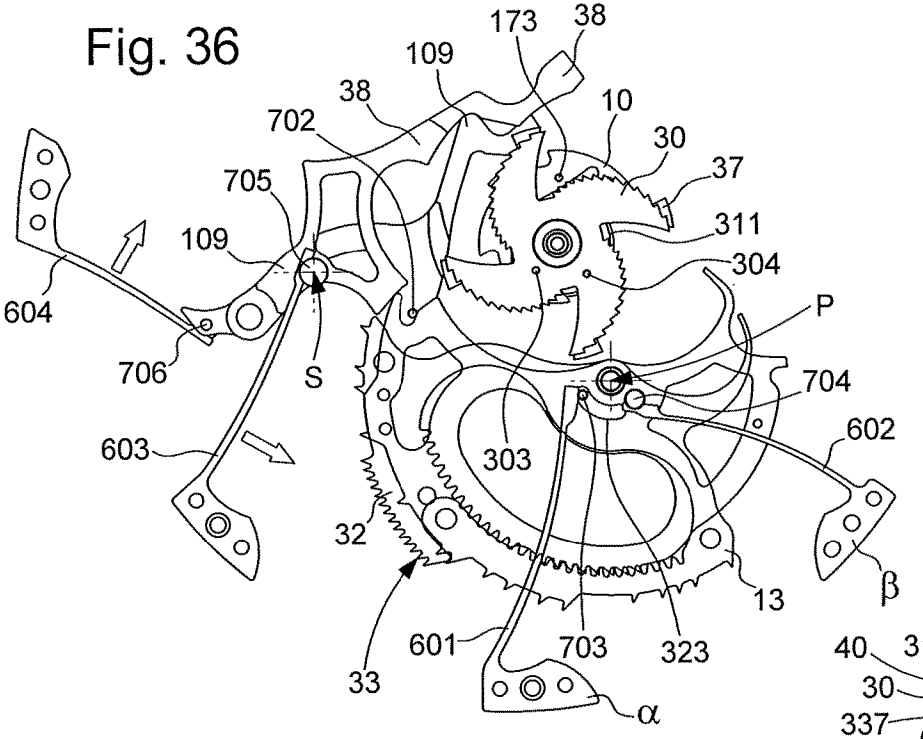

FIGS. 36 and 37 represent one part of the striking mechanism with this second variant in the rest position.

The quarter surprise-piece jumper 109 and minute surprise-piece jumper 38 are here, in a non-limiting manner, mounted to pivot about the same axis S, and are respectively subjected to the action of springs 604 and 603, which respectively act on pins 706 and 705. Quarter surprise-piece jumper 109 carries a stop pin 702, which, as seen in FIG. 36, rests on a notch of minute-rack 32, a beaked edge of which rests on minute surprise-piece jumper 38, which thus exerts a stress on minute-rack 32.

Quarter-rack 13 and minute-rack 32 are, in a non-limiting manner, mounted to pivot here about the same axis P, and are respectively subjected to the action of springs 602 and 601. An oblong groove 323 allows the travel of a pin 703 supporting the spring 601.

FIG. 37 shows the cooperation between second aperture 337 of minute surprise-piece 37 and second banking pin 304 of minute-snail 30.

When the striking mechanism is released, springs 601 and 602 respectively cause minute-rack 32 and quarter-rack 13 to pivot in order to sense their respective snail.

When minute-rack 32 is free to drop, its movement releases the two surprise-piece jumpers.

At the change of hour:

- at the fifty-ninth minute, three quarters and 14 minutes are struck, the two jumpers do not move the surprise-pieces;
- at zero minutes on the full hour, only the four quarters are struck, the minute jumper moves and shifts the minute surprise-piece to feel the upper step and limit the travel of the minute-rack. The quarter surprise-piece jumper moves against the quarter surprise-piece but does not activate it;
- at the instant of the first minute, when it is not desired to strike a quarter, but simply one minute, the minute surprise-piece is shifted by its jumper, and the quarter surprise-piece is also shifted by its jumper.

At the instant of the 59th minute, as seen in FIG. 39, minute-rack 32 drops, the minute surprise-piece jumper is released and moves onto the coaxial circular profile of the minute surprise-piece, without thereby causing any movement: the minute surprise-piece jumper 38 comes to rest, via an edge 380 thereof, on the circular periphery 370 of the minute surprise-piece 37. This Figure shows the cooperation between second aperture 337 of minute surprise-piece 37 and second bearing pin 304 of minute-snail 30 in the five o'clock position in this aperture, and the cooperation between first aperture 437 of minute surprise-piece 37 and first bearing pin 303 of minute-snail 30 in the one o'clock position in its aperture.

Beak 320 of the minute-rack is in the reading position at the bottom of the notch of minute-snail 30, at the fourteenth notch.

The beak 130 of quarter-rack 13, as seen in FIGS. 40 and 41, rests on the lowest level 115 of quarter-snail 10.

First snail pin 173 rests on side 2190 of notch 216 of upper portion 219.

FIG. 41 shows the release of the quarter surprise-piece jumper, which moves against the quarter surprise-piece, the quarter-rack rotates clockwise into abutment. The quarter surprise-piece does not move yet, since one of the faces 1099 of a male V-shaped portion of the quarter surprise-piece jumper 109 is resting on edge 318 of lower portion 319 of quarter surprise-piece 19.

At the instant of zero minute, when the striking mechanism is released, the minute-rack is released, in addition to the minute surprise-piece jumper, which comes into contact with the minute surprise-piece to release the latter in time for the minute-rack to feel the upper step and limit its travel. Pin 304 is then stopped inside its housing. As seen in FIG. 42, minute surprise-piece jumper 38 rests, via a portion 381 in a spoke shape thereof next to edge 380, on an edge 371 of minute surprise-piece 37 at the end of its circular shoulder 370. Beak 320 of minute-rack 32 bears on another circular shoulder 370 of minute surprise-piece 37. Second bearing pin 304 is in the nine o'clock position in its aperture 337, and first bearing pin 303 is in the seven o'clock position in its aperture 437. When the minute surprise-piece pivots, the quarter-snail also pivots. The beak 130 of quarter-rack 13 penetrates deep inside radial notch 116 of quarter-snail 10, resting on lug 237, it is the lowest step which is then accessible to the quarter-rack. Striking zero minutes is equivalent to striking sixty minutes, namely four quarters.

First snail pin 173 is still resting on flank 2190 of notch 216 of upper portion 219.

The two jumpers are released together. FIG. 44 shows that edge 1090 of the V-shaped portion of quarter surprise-piece jumper 109 is resting on the peripheral circular portion 317 of lower portion 319 of quarter surprise-piece 19, therefore nothing happens at this level.

At the instant of the first minute, no quarters need to be chimed, only one minute. When the striking mechanism is released, the minute surprise-piece jumper is released, which acts on the minute surprise-piece to shift it sufficiently for the minute-rack to sense the lower step. As seen in FIG. 45, minute surprise-piece jumper 38 is still resting, via its portion 381 in a spoke shape, on edge 371 of minute surprise-piece 37. Beak 320 of minute-rack 32 is resting radially on the largest diameter 302 of minute-snail 30, and resting tangentially on another edge 371 of minute surprise-piece 37. Second bearing pin 304 is still in the nine o'clock pin in its aperture 337, and first bearing pin 303 is still in the seven o'clock position in its aperture 437. The beak 130 of quarter-rack 13 is resting radially on the largest diameter 218 of the upper portion 219 of quarter surprise-piece 19.

The object is to prevent the quarter-rack feeler from dropping down to lug 237. Thus, the quarter surprise-piece jumper acts on the quarter surprise-piece in order to shift it and interpose an additional step opposite the quarter-rack, to prevent the latter from falling. As seen in FIG. 46, first snail pin 173 is now resting on the other side 217 of notch 216 of upper portion 219.

FIG. 47 shows that edge 318 of lower portion 319 of quarter surprise-piece 19 is resting on a circular part 1091 of the V-shaped portion of quarter surprise-piece jumper 109.

Thus, this mechanism makes it possible to prevent striking four-quarters if the user starts the minute repeater at the 59th minute. It ensures that, at zero minutes, the minute-snail and the quarter-snail are correctly shifted to accurately strike the four quarters and zero minutes, and that, when the first minute arrives, the quarter surprise-piece is shifted as necessary to ensure that no quarters are struck, but only one minute.

The invention also concerns a watch 1000, which is a mechanical watch with a carillon striking mechanism, and includes such a movement 200.

The invention also concerns a clock 2000, which is a mechanical clock with a carillon striking mechanism, and includes such a movement 200.

The invention thus ensures the perfect operation, at the precise time, of a carillon striking mechanism. This operation is obtained by means of a conventional assembly, and does not need complex adjustment requiring particular expertise. The striking mechanism according to the invention is of limited size, in particular in the illustrated variant of a snail assembly forming a compact and easy-to-install unit.

The invention is compatible with a grande sonnerie mechanism which also includes a minute-repeater mechanism for striking on demand, in which case the mechanism strikes first the hours, then the quarter-hours by the carillon melody, and then the minutes, when released by the user.

What is claimed is:

1. A timepiece movement including a carillon striking mechanism, arranged to strike at least hours and quarter-hours, with, for each one-hour period, a different melody for each quarter-hour and for the full hour, said movement including a first drive means arranged to drive at least a quarter-snail, and said striking mechanism including:

an hour-snail, which is carried by an hour-star wheel held by an hour-jumper and positioned every hour by a quarter-pin integral with said quarter-snail, a quarter-rack drive pinion driven by a strike train, and arranged to drive a pivoting quarter-rack, whose pivoting travel is limited by a quarter-feeler integral with said quarter-rack and which is arranged to come to rest on said quarter-snail, a pivoting minute-rack, pivoting travel of the minute-rack being limited by a minute-feeler which is integral with said minute-rack and arranged to come to rest on a minute-snail driven by said drive means of said movement, said quarter-rack comprising a second drive means arranged for driving drive teeth of said minute-rack, a minute surprise-piece coaxial to and superposed on said minute-snail, integral in rotation with said quarter-snail, and at least partially free to pivot with respect to said minute-snail, cooperating with a minute surprise-piece jumper and arranged to extend a zero minute step comprised in said minute-snail, immediately after a change of quarter-hour and during a first minute after the quarter-hours, wherein said striking mechanism includes a quarter surprise-piece coaxial to and superposed on said quarter-snail, and at least partially free to pivot in a limited angular travel with respect to said quarter-snail, arranged to ensure sequential playing of melodies of the four quarter-hours on the full hour, in a first minute of the new hour, and further includes, in a plane of said quarter surprise-piece, a quarter surprise-piece jumper, arranged to at least one of drive or lock said quarter surprise-piece.

2. The movement according to claim 1, wherein said quarter surprise-piece jumper is independent of said minute surprise-piece jumper.

3. The movement according to claim 1, wherein said quarter surprise-piece jumper forms a one-piece assembly with said minute surprise-piece jumper.

4. The movement according to claim 1, wherein said quarter surprise-piece jumper is articulated with said minute surprise-piece jumper.

5. The movement according to claim 1, wherein said quarter-rack includes first quarter teeth arranged to cooperate with a first quarter hammer trip for actuating a first quarter hammer arranged to strike a first quarter gong, and second quarter teeth, arranged to cooperate with a second quarter hammer trip for actuating a second quarter hammer arranged to strike a second quarter gong, said first quarter teeth and second quarter teeth being spaced apart to obtain a series of first sounds and second sounds, to strike the quarter-hours.

6. The movement according to claim 1, wherein said striking mechanism is arranged to strike minutes, wherein said minute-rack includes minute teeth arranged to cooperate with a minute hammer trip for actuating a minute hammer arranged to strike a minute gong.

7. The movement according to claim 1, wherein said striking mechanism includes a strike barrel, which is wound by a winding stem comprised in said movement, and comprises, for releasing the striking mechanism, a release lever which gears with a detent ratchet causing release of said minute-rack, of said quarter-rack, and of an hour-rack, the minute-rack, the quarter-rack, and the hour-rack each including a return spring, arranged to respectively press said the minute-rack, the quarter-rack, and the hour rack onto the minute-snail, the quarter-snail, and the hour-snail, when released by said detent ratchet.

8. The movement according to claim 1, wherein said striking mechanism includes a snail assembly comprising, coaxially mounted about a common axis:

said minute-snail which includes a tubular portion on which pivots a first bore of said quarter-snail, which includes, on either side of a quarter-collar carrying on a rim thereof a quarter cam, a first shoulder for centering a bore of said minute surprise-piece inserted between said quarter-collar and a minute-collar comprised in said minute-snail, and an arbor portion, on which pivots a bore of said quarter surprise-piece, which is confined between said quarter-collar and an hour driver pressed onto said arbor portion and integral with said quarter-snail, and arranged to limit axial play of said quarter surprise-piece, which hour driver carries said quarter pin parallel to said axis for driving said hour-star wheel.

9. The movement according to claim 8, wherein said snail assembly also includes a cannon-pinion wheel, which is integral in rotation with said minute-snail, driven by said first drive means of said movement, and making one revolution per hour.

10. The movement according to claim 8, wherein said snail assembly also includes a finger pressed onto said tubular portion, and arranged to limit axial play of said quarter-snail, and to lock or unlock the striking mechanism, by cooperating with a lever comprised in said striking mechanism, to release an hour drive means on the full hour.

11. The movement according to claim 8, wherein said snail assembly also includes a four-toothed star wheel, pressed onto said tubular portion, and arranged to release a grande sonnerie mechanism at each quarter-hour.

12. The movement according to claim 1, wherein said quarter surprise-piece includes a banking pin arranged to cooperate with a first housing comprised in said quarter-snail.

13. The movement according to claim 1, wherein said minute-snail includes a first bearing pin arranged to cooperate in abutment with a strip spring cantilevered on a point of attachment of said quarter-snail.

14. The movement according to claim 13, wherein said minute surprise-piece includes a first aperture inside which said first bearing pin is movable in a limited travel.

15. The movement according to claim 1, wherein said minute snail includes a second banking pin arranged to cooperate with a second housing comprised in said minute surprise-piece.

16. The movement according to claim 1, wherein said quarter surprise-piece includes, coaxial and integral in rotation, at least an upper portion and a lower portion which includes, at an end of a substantially circular spring arm, a second eye arranged to cooperate with a third pin of said quarter-snail, which third pin is movable inside a radial notch comprised in said upper portion, to limit a travel of the upper portion with respect to said quarter-snail.

17. The movement according to claim 16, wherein said upper portion includes circular sectors of different radii corresponding to respective sectors of said quarter-snail.

18. A watch, wherein said watch is a mechanical watch with a carillon striking mechanism, and includes a movement according to claim 1.

19. A clock, wherein said clock is a mechanical clock with a carillon striking mechanism, and includes a movement according to claim 1.

* * * * *